United States Patent [19]

Iwai et al.

[11] 4,224,357

[45] Sep. 23, 1980

[54] METHOD AND COMPOSITION FOR FORMING ELECTRON BEAM CURING HIGH BUILD COATING

[75] Inventors: Hiroshi Iwai; Hajime Sukejima; Osamu Isozaki, all of Hiratsuka, Japan

[73] Assignee: Kansai Paint Co., Ltd., Japan

[21] Appl. No.: 846,797

[22] Filed: Oct. 31, 1977

[30] Foreign Application Priority Data

Mar. 14, 1977 [JP] Japan ..... 52/27860
Apr. 1, 1977 [JP] Japan ..... 52/37016

[51] Int. Cl.[2] ..... B05D 3/02

[52] U.S. Cl. ..... 427/44; 204/159.14; 204/159.19; 204/159.20; 427/54.1; 427/258; 427/287; 427/412.5; 427/409; 427/410; 427/421; 427/428; 428/413; 428/458; 428/462; 428/463; 525/111; 525/438; 525/454; 525/524; 525/528; 525/529; 528/103; 528/392; 428/423.1; 428/425.8

[58] Field of Search ..... 427/44, 54, 258, 287, 427/409, 410, 407 G, 425, 428; 204/159.14, 159.20, 159.19; 428/413, 423, 457 R, 458, 462, 463; 528/203, 392; 525/111, 438, 454, 524, 528, 529

[56] References Cited

U.S. PATENT DOCUMENTS

| | | | |
|---|---|---|---|
| 3,674,545 | 7/1972 | Strolle | 427/44 |
| 3,699,023 | 10/1972 | Kuhar | 204/159.19 |
| 3,867,351 | 2/1975 | Juna et al. | 427/44 X |
| 3,882,189 | 5/1975 | Hudak | 204/159.19 X |
| 3,948,666 | 4/1976 | Kitanishi et al. | 204/159.19 X |
| 4,013,806 | 3/1977 | Volkert et al. | 427/54 |
| 4,025,692 | 5/1977 | Yamagishi et al. | 427/44 X |
| 4,064,026 | 12/1977 | Kaufman | 204/159.19 |
| 4,082,634 | 4/1978 | Chang | 427/54 X |
| 4,104,432 | 8/1978 | Manabe et al. | 427/54 X |
| 4,108,840 | 8/1978 | Friedlander | 204/159.19 X |

*Primary Examiner*—John D. Smith
*Assistant Examiner*—Thurman K. Page
*Attorney, Agent, or Firm*—Ostrolenk, Faber, Gerg & Soffen

[57] ABSTRACT

A method and a composition for forming electron beam curing high build coating film which method comprises the steps of preparing a specified coating composition, applying it to the surface of a substrate to be coated, and curing the coating film with the irradiation of electron beams or ultraviolet rays. The coating composition of the invention comprises a polymerizable resin (I) as the main vehicle component which is cured by the irradiation of electron beams or ultraviolet rays and has at least two polymerizable unsaturated double bonds and at least one hydroxyl group in its molecule, and a polyisocyanate compound (II). Further, a resin (III) having active unsaturated groups can be added to the above coating composition so as to improve the pot life of the composition.

14 Claims, No Drawings

METHOD AND COMPOSITION FOR FORMING ELECTRON BEAM CURING HIGH BUILD COATING

BACKGROUND OF THE INVENTION (1) Field of the Invention

This invention relates to a method for applying electron beam curing high build coating and the coating composition therefor. More particularly, the invention relates to a method and composition for forming high build coating films such as multicolor finish, sand texture finish, rugged surface finish, multilayer finish, mastic finish and flock finish, which coating film are cured by applying electron beams, ultraviolet rays or the like.

(2) Description of the Prior Art

The coating materials of this kind are generally applied thickly (about 300 microns or more) and subjected to forced drying in every coating process. It is well known however, that several defects of the coating films such as checking, cracking, shrinking and popping are liable to occur when these high build coating are rapidly heated. As the method for eliminating these disadvantages, the curing of coating films by applying electron beams or ultraviolet rays has been proposed, but it is difficult to apply ordinary electron beams into the depth more than 300 microns of coating films, and much less when aggregates are contained in coating films. That is, electron beams cannot reach behind the aggregates as the beams are shaded by the aggregates and the coating material behind the aggregates cannot be cured. This tendency may be said of the use of ultraviolet rays. As a result, the durability of coating film becomes poor.

Further, several unsaturated resin coating compositions of radiation curing type have been proposed, however, the volumetric shrinkage is large if they are cured in a short time, and as a result, the adhesion of them to iron and other metal surfaces is not good. Furthermore, in connection with the insufficient curing of coating material in the shade portion during the curing with ionizing radiation, urethane type coating materials are thought of, however, the pot life of them are usually less than about 5 hours or so, while in the case that the pot life of such coating material is intended to prolong, the curing property in the initial stage becomes worse. As a result the conventional coating compositions have been restricted by several points in practical uses.

BRIEF SUMMARY OF THE INVENTION

In order to eliminate the above-described disadvantages accompanying the conventional coating compositions, the inventors of the present application have carried out extensive studies, and as a result, the present invention has been accomplished.

It is, therefore, the primary object of the present invention to provide a method and a composition for forming improved high build coating films which are cured by electron beams or the like.

Another object of the present invention is to provide a method and a composition for forming electron beam curing high build coating films which have excellent durability and other good physical properties.

A further object of the present invention is to provide a method and a composition for forming such coating films that can be cured rapidly and completely even in the shade portion produced by aggregates in the coating film.

Still a further object of the present invention is to provide a method and a composition for forming the above coating films, in which the coating composition has a long pot life which facilitates coating work and enhances work efficiency.

According to the present invention, the method for forming high build coating films comprises the steps of: preparing a coating composition by adding polyisocyanate compound or compounds (II) to a basic coating material, as the main vehicle component, of electron beam or ultraviolet ray curing polymerizable resin (I) which has at least two polymerizable unsaturated double bonds and at least one hydroxyl group in its molecule, applying the coating composition to articles and curing the coated films by the irradiation of electron beams or ultraviolet rays.

Further, the coating composition for forming high build coating films is included in the present invention. As described above, the composition comprises: a basic coating material, as the main vehicle component, of polymerizable resin (I) which has at least two polymerizable unsaturated double bonds and at least one hydroxyl group in its molecule and is cured by the irradiation of electron beams or ultraviolet rays, and a polyisocyanate compound or compounds (II). The above polymerizable double bonds are responsive to and polymerized by electron beams or ultraviolet rays, and the above hydroxyl group forms an urethane bond with the isocyanate group in the above isocyanate compound (II). Therefore, the insufficient curing that is caused in the shade of aggregates from electron beams to ultraviolet rays can be compensated for by the reaction between the hydroxyl groups in the polymerizable resin (I) and the isocyanate groups in the polyisocyanate compound (II).

As the result, the obtained coating film becomes tough owing to the urethane bonds and it has good properties such as stain resistance, solvent resistance, surface hardness and weather resistance owing to the curing with electron beams or ultraviolet rays. Therefore, the coating composition of the present invention is of great utility value in, for example, the production of building materials which is required to be extremely durable.

In a further aspect of the present invention, the pot life of the coating composition can be prolonged by adding a resin (III) having active unsaturated groups to the above coating composition of the polymerizable resin (I) and polyisocyanate compound (II). the above active unsaturated groups of the resin (III) may be introduced by the reaction of a compound having epoxy groups with a monomer having both epoxy group and active unsaturated group through the medium of at least one member selected from the group consisting of orthophosphoric acid, orthophosphorous acid and sulfuric acid. With the use of the above resin (III) having active unsaturated groups, the pot life of the coating composition can be elongated to 24 hours or more, and in addition, the adhesive property to metal surfaces can be much improved.

DETAILED DESCRIPTION OF THE INVENTION

The foregoing polymerizable resin (I) having hydroxyl groups and polymerizable double bonds may be any known one which can be cured by the irradiation of electron beams or ultraviolet rays. Exemplified as such resins are polyester resin, acrylic resin, butadiene resin, urethane resin and epoxy resin.

Applicable acrylic resins are those having at least two acryloyl (or methacryloyl) groups and at least one hydroxyl group in its molecule. In order to clarify the molecular structures of the resins, some chemical structural formulae will be exemplified in the following.

(a)

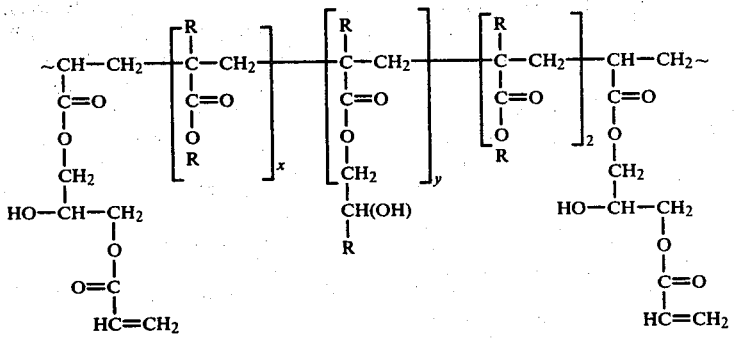

(b)

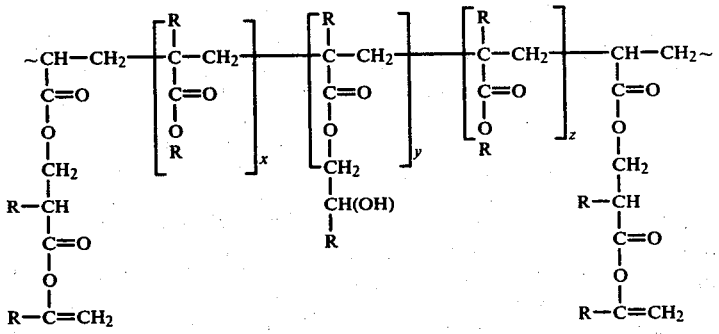

(c)

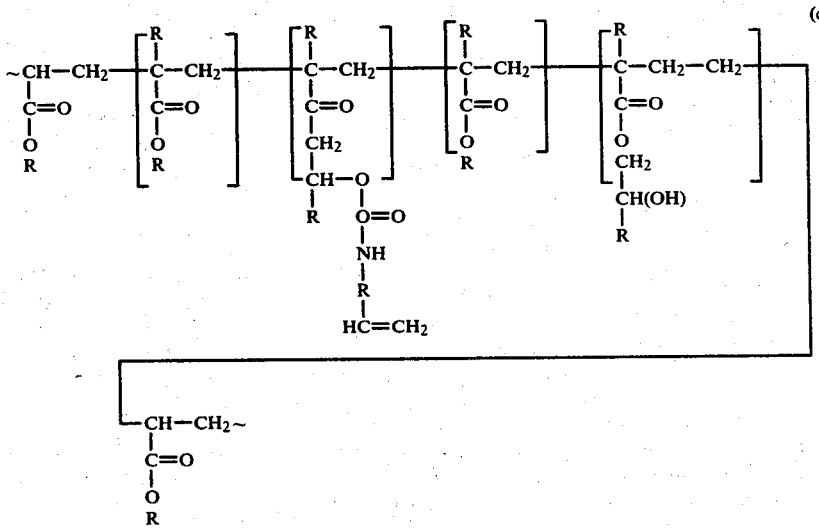

In the above formulae, the symbol R represents a hydrogen atom or an alkyl group and all R's are not necessarily the same groups. Each of the symbols w, x, y and z is 0 (zero) or an integer.

As the method for introducing the acryloyl (or methacryloyl) groups and hydroxyl groups, several known methods are employed. For example, there is the esterification of the hydroxyl groups and oxirane groups in resin or oligomer with unsaturated carboxylic acids such as acrylic acid and methacrylic acid, or the esterification of the carboxyl groups contained in the resin or oligomer with the glycidyl ethers of acrylic acid (or methacrylic acid) and unsaturated alcohols (such as hydroxyethyl acrylate, hydroxymethyl methacrylate, allyl alcohol, hydroxypropyl acrylate, hydroxypropyl methacrylate, hydroxyethyl crotonate, cinnamic alcohol and crotonyl alcohol). Further, the reaction between isocyanate compound having unsaturated groups with a part of hydroxy groups and carboxyl groups contained in the resin or oligomer, can also be employed.

The polyester resin, each molecule of which contains at least one hydroxyl group, can be prepared by esterifying polybasic acid component with alcohol component, and if air curing property is required according to the expected use, allyl glycidyl ether or tetrahydrofurfural may be used together. Exemplified as the above polybasic acid components are unsaturated dibasic acid (such as maleic anhydride, fumaric acid, itaconic acid, citraconic acid and tetrahydrophthalic anhydride) or such dibasic acids which are partially substituted with saturated dibasic acids (such as phthalic anhydride, isophthalic acid, terephthalic acid, 3,6-endomethylene tetrahydrophthalic anhydride, adipic acid, sebacic acid and tetrachlorophthalic anhydride). The above alcohol components may be exemplified by dihydric alcohols (such as ethylene glycol, diethylene glycol, 1,2-propylene glycol, dipropylene glycol, hydrogenated bisphenol A, 2,2-bis(4-hydroxyethoxyphenyl)propane and 1,6-hexanediol, or the mixture of the above dihydric alcohols and monohydric alcohols or polyhydric alcohols (such as glycerol, trimethylol ethane, trimethylol propane and pentaerythritol).

The epoxy resins having polymerizable unsaturated double bonds are obtained, for example, by esterifying the oxirane groups of epoxy compounds with $\alpha,\beta$-unsaturated monobasic acid such as acrylic acid, methacrylic acid, crotonic acid and the adduct of vinyl monomer containing hydroxyl groups and dibasic acid anhydride. Exemplified as the above epoxy compounds are: common epoxy resin which is prepared by the reaction between bisphenol A and epichlorohydrin as represented by the chemical structural formula:

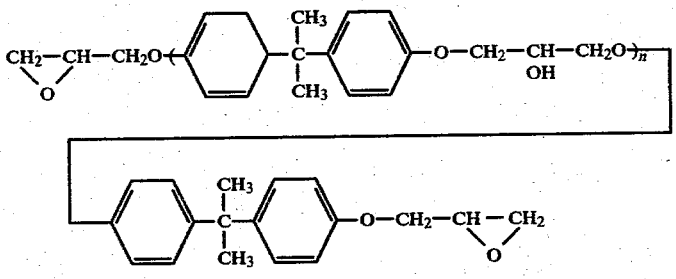

and the reaction product of the phenolic hydroxyl groups and epichlorohydrin, which is represented by the following chemical structural formula:

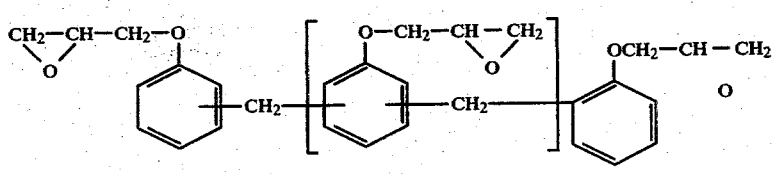

wherein n is 0(zero) or an integer of 1 to 20. and further, glycidyl ethers of aliphatic or other dihydric alcohols and trihydric alcohol.

The urethane resins may be those having urethane bonds in their skeletal structures and they are prepared by the reaction between a polyisocyanate compound and another component which is exemplified by the above-mentioned acrylic resin having at least one hydroxyl group and at least one polymerizable unsaturated double bond in its molecule, unsaturated polyester resin, epoxy resin and further, hydroxyethyl (or propyl) acrylate (or methacrylate), hydroxyethyl (or propyl) crotonate, trimethylolpropane dimethacrylate, trimethylolpropane diacrylate, trimethylolethane dimethacrylate, trimethylolethane diacrylate, glycerol dimethacrylate, allyl alcohol, cinnamic alcohol and crotonyl alcohol. The above polyisocyanate compound and another component may be so compounded as to set the molar ratio ($N=NCO/OH$) to the range of $0<N<1$.

The above-described resins having hydroxyl groups and polymerizable unsaturated groups may be used alone or in combination, and they can be used together with vinyl monomer. Exemplified as the vinyl monomers are acrylic acid and its monoesters, methacrylic acid and its monoesters, aromatic vinyl monomers, vinyl acetate, vinyl ether, di or triesters prepared by esterification of acrylic or methacrylic acid with polyhydric alcohols such as ethylene glycol, diethylene glycol, triethylene glycol, tetraethylene glycol, propylene glycol, dipropylene glycol, tripropylene glycol, butylene glycol, 1,6-hexanediol, glycerol, trimethylolethane, trimethylolpropane and pentaerythritol, and diesters prepared by esterification of polybasic acids such as phthalic anhydride, adipic acid, succinic acid and hexahydrophthalic anhydride with vinyl monomers having hydroxyl group such as hydroxyethyl acrylate, hydroxypropyl acrylate, hydroxyethyl methacrylate or hydroxypropyl methacrylate. Furthermore, included in the above monomers are the reaction products of polyisocyanates and monomers which have, in their molecules, polymerizable unsaturated double bonds and reactive groups such as hydroxyl groups, carboxyl groups and amino groups which contain active hydrogen atoms to cause polyaddition reaction with isocyanate groups. The ratio of the above monomers to the polyisocyanates as represented by OH/NCO, COOH/NCO or $NH_2$/NCO is in the range of 1 to 1.2. Further, the above monomers are exemplified by allyl alcohol, 2-hydroxyethyl methacrylate, cinnamic alcohol, crotonyl alcohol, hydroxydicyclopentadiene, cinnamic acid, itaconic acid, N-methylol acrylamide and crotonic acid. The above polyisocyanates are exemplified by triisocyanate composed of 3 moles of tolylene diisocyanate and 1 mole of trimethylolpropane, triisocyanate having biuret bonds which is composed of 3 moles of hexamethylene diisocyanate and 1 mole of water, triisocyanate composed of 3 moles of hexamethylene diisocyanate and 1 mole of trimethylol propane, diphenylmethane-4,4'-diisocyanate, 4,4'-methylenebiscyclohexyl diisocyanate, 2,6-diisocyanate methylcaproate, xylene diisocyanate and 1,5-naphthylene diisocyanate.

The compounding ratio of the above-described vinyl monomers to the polymerizable resin (I) may be freely determined provided that the obtaining mixture has suitable viscosity for coating operation (this mixture is hereinafter referred to as "resin varnish").

The compounding ratio of these resin varnishes and the polyisocyanate compounds (II) as curing agents may be within the range of 0.8 to 1.6 as represented by the molar ratio OH/NCO, wherein OH means the OH group in a resin varnish and NCO means NCO group in polyisocyanate. When the molar ratio is more than 1.6 the curing by urethanation reaction becomes insufficient, while the molar ratio of less than 0.8 results in the lack of durability since excessive NCO groups are contained.

The polyisocyanate compounds (II) which are used as curing agents may be exemplified by tolylene diisocyanate, diphenylmethane diisocyanate, lysine diisocyanate methyl ester, dicyclohexyl metadiisocyanate, isophorone diisocyanate, xylylene diisocyanate, hexamethylene diisocyanate, and the addition compounds of the above diisocyanates with polyhydric alcohols, water and so forth such as Desmodur L, Desmodur N (both are trademarks, made by Farbenfabriken Bayer A.G.), Coronate HL (trademark, made by Nippon Polyurethane Industry Co., Ltd.) and LDI-A 200 (trademark, made by Toray Industries Inc.).

As described in the foregoing, the resin (III) having active unsaturated groups can be added to the above coating composition so as to extend the pot life and to improve the adhesion to metal surfaces. The resin (III) is prepared by introducing active unsaturated groups by the reaction of the compound (A) having epoxy groups with a monomer (B) having both epoxy group and active unsaturated group through the medium of one or more compounds (C) selected from the group consisting of orthophosphoric acid, orthophosphorous acid and sulfuric acid. In another method to introduce active unsaturated groups, the compound (A) having epoxy groups is allowed to react with a compound (D) which is represented by the general formula:

$$HmX(R'-\underset{\underset{O}{\|}}{C}-\underset{\underset{R''}{|}}{C}=CH_2)_n$$

in which the symbol m and n are respectively integers of 1 or 2, R' is a hydrocarbon group or halogenated hydrocarbon group having 2 to 20 carbon atoms, R'' is a hydrogen atom or methyl group, and X is $PO_4$, $PO_3$ or $SO_4$.

The compound (A) having epoxy groups is a polymer or an oligomer which has at least one epoxy group in its molecule. The compound (A) having epoxy groups is exemplified by epoxy resins having bisphenol skeletal structure such as Epon 828, 1001, 1004, 1007 and 1009 (all trademarks, made by Shell Chemical Co.), glycidyl ether resins, for example, Shodine 500 (trademark, made by Showa Highpolymer Co., Ltd.) epoxidized oil, Cardura E (trademark, glycidyl ester synthetic tertiary carboxylic acid made by Shell Chemical Co.), and copolymers containing glycidyl methacrylate or glycidyl acrylate. Further, the reaction product into which skeletal structure, epoxy groups are introduced by modifying polyester, acrylic urethane or polybutadiene with polyepoxy compounds, can also be used. These epoxy compounds (A) may be either saturated or unsaturated.

The monomer (B) having both epoxy groups and active unsaturated groups is exemplified by glycidyl acrylate, glycidyl methacrylate and acryl glycidyl ether.

The above-mentioned compounds (D) that were indicated by the foregoing general formula are the adducts of inorganic polybasic acid (C) and monomers having hydroxyl groups and active unsaturated groups. The monomers having hydroxyl groups and active unsaturated groups are exemplified by 2-hydroxyethyl acrylate (or methacrylate), 2-hydroxypropyl acrylate (or methacrylate), 3-hydroxypropyl acrylate (or methacrylate), 3-chloro-2-hydroxypropyl acrylate (or methacrylate), allyl alcohol, monoadducts of glycidyl acrylate or glycidyl methacrylate with carboxylic acid such as benzoic acid, and monoadducts of acrylic acid or methacrylic acid with epoxy compound such as epichlorohydrin.

As these compounds (D), there are Phosmer M (trademark, made by Yushi Seihin Co., Ltd.) and Kayamer PM-2 (trademark, made by Nippon Kayaku Co., Ltd.).

It is preferable for the introduction of active unsaturated bonds into epoxy compounds that the reaction product between an inorganic copolybasic acid (C) and a monomer (B) having epoxy groups and active unsaturated groups, is allowed to react with a compound (A) having epoxy groups, or the adduct prepared from a compound (A) having epoxy groups and an inorganic polybasic acid (C), is caused to react with a monomer (B) having epoxy groups and active unsaturated groups. When a monomer having one epoxy group per molecule is used as the above monomer (B), the above three components can react together simultaneously.

The reaction of the inorganic polybasic acid (C) with epoxy groups of the compound (A) and/or the monomer (B), and the reaction between the compound (A) and the foregoing compound (D) can be accomplished at about 60° to 150° C. for about 3 to 10 hours with heating and stirring. The end point of the reaction is determined by measuring acid value. It is desirable that the ratio of reaction is 90% or more and the quantity of free inorganic acid is made as small as possible. In order to avoid the thermal polymerization of active unsaturated groups in the above reactions, 50 to 1000 ppm of a polymerization inhibitor such as hydroquinone is preferably added.

The content of inorganic polybasic acid in the above unsaturated resin (III) may be within the range of 1 to 50% by weight, and preferably 2 to 30% by weight. The number of active unsaturated bonds that are introduced by using inorganic polybasic acid may be one or more.

The compounding ratio of the polymerizable resin (I) and the above resin (III) having active unsaturated groups is not restricted especially, however, the preferable compounding ratio of them is in the range of 1 to 40 parts by weight of the resin (III) to 100 parts by weight of the polymerizable resin (I).

The coating composition of the present invention can be, of course, added with common aggregates such as silica sand, pearlite, calcium carbonate, vermiculite, glass powder, silas balloon, hollow glass spheres, glass flakes, aluminum powder, asbestos, glass fiber and organic fibrous materials. Further, in like manner as ordinary coating materials, several extenders, coloring pigments, dyestuffs and pearl essence can be disersed in the coating composition of the present invention.

Further, the clear or pigmented coating composition is applied to the surfaces of articles and the aggregate is immediately spread over the wet coating surfaces, and then the same coating composition is further applied over them. Such coating films are cured by the irradiation of electron beams. Further, when the coating composition of the present invention is clear or translucent, the coating films thereof can also be cured by the application of ultraviolet rays. In this case, however, a known photosensitizer must be added to the coating composition as well known in the conventional art.

When the above-described method of the present invention for forming high build coating film is practiced, uncured portions do not remain even in the shades of aggregates to which the electron beams or ultraviolet rays do not get, because urethane bonds are formed by the reaction between OH groups and NCO groups in the composition. When the thickness of a coating film is large, the curing ratio of every portion of such coating film become quite different in the prior art methods, however, such disadvantage can be avoided by the method of the present invention. Further, the portions other than the shades of aggregate particles and the deeper portion of coating film to which electron beams are not sufficiently given, can be cured in several seconds. Therefore, even when coated articles are piled immediately after irradiation, neither surface damage nor blocking occurs so that the method and the composition of the present invention are quite useful in practical industries.

Exemplified as the electron accelerators used for the irradiation of electron beams, are Cockcroft type, Cockcroft-Walton type, Van de Graaff type, resonator-transformer type, insulating core-transformer type, dynatron type and high-frequency type. The coating films are cured by applying the electron beams having 100 to 2000 keV (more preferably, 150 to 600 keV) accelerated energy which are generated by the above electron accelerators. The dose of electron beams is generally 0.5 to 50 Mrads, and preferably 5 to 20 Mrads.

In order that those skilled in the art may better understand the present invention and the manner in which it may be practised, the following specific examples are given. In these examples, unless otherwise indicated, parts and percents are by weight.

Preparation Examples of Resin Varnishes

Preparation Example 1

| Used materials in this Preparation Example 1 were as follows: | |
|---|---|
| (a) n-butyl acrylate | 350 parts |
| (b) styrene | 190 parts |
| (c) glycidyl methacrylate | 80 parts |
| (d) 2-hydroxyethyl acrylate | 20 parts |
| (e) benzoyl peroxide | 20 parts |
| (f) hydroquinone | 0.3 part |
| (g) acrylic acid | 40 parts |
| (h) xylene | 300 parts |
| (j) tetraethyl ammonium bromide | 2 parts |

In a nitrogen blanket, the xylene in a reaction vessel was heated to 130° C. with continuous stirring, then the above monomers (a), (b), (c) and (d), and the reaction initiator (e) were added to the vessel over about 1.5 horus. The whole of the above mixture was then heated to 130° C.-135° C. for about 3 hours, and thereafter, it was cooled to about 60° C. Further, the above (f), (g) and (j) were added to the contents of the reaction vessel and the temperature was gradually raised to 135° C. over aobut 1.5 hours. The contents was maintained at this temperature for about 1.5 hours. The acrylic resin that was obtained by removing xylene, was added with 1,6-hexanediol methacrylate to form a resin varnish of 70% in solid content.

Preparation Example 2

| Used materials were as follows: | |
|---|---|
| (a) styrene | 400 parts |
| (b) methyl methacrylate | 400 parts |
| (c) 2-hydroxyethyl methacrylate | 190 parts |
| (d) acrylic acid | 40 parts |
| (e) azoisobutyronitrile | 23 parts |
| (f) hydroquinone | 0.5 part |
| (g) p-toluene sulfonate | 4 parts |
| (h) xylene | 74 parts |
| (i) butyl acetate | 156 parts |

In a nitrogen blanket, the xylene and butyl acetate in a reaction vessel were heated to 112° C. with continuous stirring. The monomers (a), (b) and (c) were fed into a dropping vessel and (e) was dissolved into the monomer mixture. The monomer mixture was then dropped into the reaction vessel over about 3 hours from the monomer dropping vessel. The whole contents were further heated to 112° C. for about 3 hours and they were then cooled to about 60° C. The materials (d), (f) and (g) were added to the above obtained contents and the temperature was raised to 112° C. gradually within about 1.5 hours. The contents were maintained at this temperature for about 1.5 hours and methyl methacrylate was added to the acrylic resin which had been prepared by removing the solvent, thereby obtaining a resin of 80% in solid content.

Preparation Example 3

| Used materials were as follows: | |
|---|---|
| (a) styrene | 340 parts |
| (b) methyl methacrylate | 260 parts |
| (c) butyl acrylate | 100 parts |
| (d) hydroxyethyl acrylate | 190 parts |
| (e) acrylic acid | 10 parts |
| (f) adduct of xylene diisocyanate with 2-hydroxyethyl acrylate | 90 parts |
| (g) azoisobutyronitrile | 20 parts |
| (h) xylene | 75 parts |
| (i) butyl acetate | 160 parts |

In a nitrogen blanket, the xylene and butyl acetate in a reaction vessel were heated to 112° C. with continuous stirring. The monomers (a), (b), (c), (d) and (e) were fed into a dropping vessel and (g) was then dissolved into the above monomer mixture. The monomer mixture was then dropped into the reaction vessel over about 3 hours from the monomer dropping vessel. The whole contents were heated to 112° C. for about 3 hours and they were then cooled to about 50° C. The material (f) was added to the above obtained contents and the temperature thereof was maintained at this level for about one hour. Trimethylolpropane trimethacrylate was then added to the acrylic resin which was prepared by removing the solvent, thereby obtaining a resin of 65% in solid content.

Preparation Example 4

To a four neck flask, 1000 parts of Epikote 1004 (trademark of epoxy resin made by Shell Chemical Co.; epoxy equivalent=924) and 58.5 parts of acrylic resin were fed and the contents were allowed to react by heating to 130°-150° C. with refluxing in the presence of nitrogen gas. In this reaction, 1.06 parts of tri-n-butylamine as a reaction accelerator and 0.06 part of hydroquinone as a polymerization inhibitor were added to the reaction system. The acid value become 2.4 after about 2 hours and in this stage, the reaction was stopped. Ethylene glycol dimethacrylate was added to 100 parts of thus obtained epoxy resin to prepare a resin varnish of 70% in solid content.

Preparation Example 5

| Used materials were as follows: | |
|---|---|
| (a) phthalic anhydride | 300 parts |
| (b) hexahydrophthalic anhydride | 600 parts |
| (c) adipic acid | 290 parts |
| (d) 2,2-dimethylpropanediol | 760 parts |
| (e) glycidyl methacrylate | 250 parts |
| (f) hydroquinone | 1 part |
| (g) tetraethyl ammonium bromide | 1 part |
| (h) xylene | 100 parts |
| (i) toluene | 890 parts |
| (j) methanol | 1 part |

The above materials (a), (b), (c) and (d) were fed into a reaction vessel and the contents were heated in the presence of nitrogen gas. When the materials were melted to some extent, stirring was begun and heated up to 160° C. Then the temperature of the contents was gradually raised to 220° C. over about 3 hours. The contents were further allowed to react for 2 hours and solvent condensation was started by adding the material (h). After the acid value become 62, the reaction product was cooled to 110° C., diluted with toluene, and the materials (f), (g) and (j) were fed into the diluted product. The material (c) was further added with stirring and the reaction was continued for 2 hours at 120° C. When the acid value became 10, the reaction product was cooled to 110° C. to obtain polyester resin of 70% in solid content.

Preparation Example 6

Through a well known method of condensation, unsaturated polyester resin was synthesized from 3 moles of fumaric anhydride, 4 moles of phthalic anhydride, 2 moles of propylene glycol, 2 moles of trimethylolpropane and 4 moles of allyl glycidyl ether. The above condensation product was then diluted with a mixture of a polymerizable monomer and methyl methacrylate of the same volume to obtain a resin varnish of 65% in solid content.

The above polymerizable monomer was prepared by the following method. 25.8 parts of 2-hydroxyethyl methacrylate, 69.0 parts of 65% solution of Desmodur N (trademark of a product of Farbenfabriken Bayer A. G.) in methyl methacrylate, 0.3 part of 10% solution of hydroquinone in methyl ethyl ketone, and 0.1 part of 50% solution of dibutyl tin dilaurate in xylene were allowed to react together at 90° C. for 6 hours under the existence of nitrogen gas. When more than 80% of isocyanate groups were consumed, the reaction was stopped. The remaining isocyanate group were masked with 4.8 parts of methanol and the reaction product was cooled to obtain isocyanate modified 2-hydroxyethyl methacrylate.

Preparation Example 7

To polyester prepolymer that was prepared in like manner as the foregoing Preparation Example 6, lysine diisocyanate methyl ester was added so as to adjust the molar ratio (NCO/OH) to 0.4 and the mixture was stirred at 100° C. for 1.5 hours. After removing the solvent, diethylene glycol dimethacrylate was added to obtain a resin of 70% in solid content.

Preparation Example 8

To a four neck flask, 1000 parts of Epikote 1004 resin (trademark of epoxy resin made by Shell Chemical Co.; epoxy equivalent=924) and 58.5 parts of acrylic acid were fed and they were heated and allowed to react with refluxing in the presence of nitrogen gas at 130°-150° C. at which temperature the viscosity of the contents became suitable to stirring. In this reaction, 1.06 parts of tri-n-butylamine as a reaction accelerator and 0.06 part of hydroquinone as a polymerization inhibitor were added to the reaction system. When the acid value became 2.4 after about 2 hours, the reaction was stopped and the reaction product was cooled to 60° C. The, tolylene diisocyanate was added to the reaction product so as to adjust the molar ratio of NCO/OH to 0.4 and allowed to react at 100° C. for about 1 hour. After the reaction, the reaction product was cooled and 1,3-butylene glycol diacrylate was added to the product to obtain a resin varnish of 70% in solid content.

Preparation Example 9

According to the ordinary method, 48.7 parts of methyl methacrylate, 454 parts of ethyl acrylate and 126 parts of acrylic acid were subjected to solution polymerization in xylene. The polymerization product was further allowed to react with the addition of 102 parts of glycidyl methacrylate and 2 parts of triethylamine, thereby obtaining unsaturated acrylic resin having an acid value of 53. By treating this acrylic resin varnish under a reduced pressure, a varnish of 90% in nonvolatile matter was obtained.

Then, 830 parts of this varnish was dissolved by mixing with 170 parts of 2-hydroxyethyl methacrylate. 1000 parts of thus prepared varnish was neutralized by adding 100 parts of 28% aqueous ammonia, and then, 1000 parts of city water was mixed to obtain a water varnish. To 1000 parts of this water varnish were added 100 parts of iron oxide pigment, 100 parts of talc, 100 parts of clay and 100 parts of calcium molybdate, and they were dispersed well by ball mill to obtain a primer composition.

Preparation of Coating Compositions

Coating Composition 1:

To 100 parts of the resin varnish that was prepared in Preparation Example 1 were added 100 parts of titanium oxide and 14 parts of diethylene glycol dimethacrylate, and the mixture was dispersed by a pebble mill for 16 hours.

Further, 80 parts of aggregate (Hakuoseki 5-rin: trademark of marble granules, 2 mmϕ made by Sankyo Seifun Co., Ltd.) was added to the dispersion to obtain a basic composition. To this composition was added Coronate HL (trademark of a product of Nippon Polyurethane Industry Co., Ltd.) so as to adjust the molar ratio NCO/OH to 0.8, thereby obtaining Coating Composition 1.

Coating Composition 2:

To 100 parts of the resin varnish obtained in Preparation Example 2 were added 90 parts of titanium oxide, 10 parts of oxide yellow, and 20 parts of trimethylolpropane trimethacrylate and the mixture was dispersed by a pebble mill for 20 hours to obtain a basic composition. Then, Desmodur N (trademark, a product of Farbenfabriken Bayer A. G.) was added to the above basic composition so as to adjust the molar ratio NCO/OH to 1.0, thereby obtaining Coating Composition 2.

Coating Composition 3:

To 100 parts of the resin varnish obtained in Preparation Example 3 were added 30 parts of 1,5-pentanediol dimethacrylate and 4 parts of carbon black and they were dispersed by a ball mill for 20 hours. Further, 6 parts of Syloid 308 (trademark of a product of Fuji Davison Chemical Ltd.) was added to the above dispersion to obtain a basic composition. Further, TP 1001 (trademark of urethanated polybutadiene containing 4.5% of NCO made by Nippon Soda Co., Ltd.) was added to the above basic composition so as to adjust the molar ratio NCO/OH to 0.8, thereby obtaining Coating Composition 3.

Coating Composition 4:

To 100 parts of the resin varnish obtained in Preparation Example 4 were added 30 parts of calcium sulfate and 70 parts of calcium carbonate and they were dispersed by a pebble mill for 16 hours. Further, 250 parts of siliceous sand was added to the above dispersion to obtain a basic omposition. Then, Desmodur L (trademark of a product of Farbenfabriken Bayer A. G.) was added to the basic composition so as to adjust the molar ratio NCO/OH to 1.2, thereby obtaining a Coating Composition 4.

Coating Composition 5:

To 100 parts of the resin varnish obtained in Preparation Example 5 were added 30 parts of talc and 70 parts of calcium carbonate and they were dispersed by a pebble mill for 16 hours, and then 50 parts of rock wool was added to the above dispersion to obtain a basic composition. To the basic composition, LDI-A200 (trademark of the adduct of lysine diisocyanate methyl ester and trimethylolpropane made by Toray Industries Inc.) was added so as to adjust the molar ratio NCO-/OH to 1.0, thereby obtaining Coating Composition 5.

Coating Composition 6:

To 100 parts of the resin varnish obtained in Preparation Example 6 were added 10 parts of trimethylolpropane triacrylate and 4 parts of Cyanine Blue and they were dispersed by a ball mill for 16 hours. Further, 100 parts of Grani Calcium (a product of Hoechst Synthetics Co., Ltd.) and 10 parts of aluminium powder (trademark: Alumi Paste 46-046 made by Toyo Aluminium K. K.) were added to the above dispersion to obtain a basic composition. Coronate HL (trademark of a product of Nippon Polyurethane Industry Co., Ltd.) was added to the above mixture so as to adjust the molar ratio NCO-/OH to 0.8, thereby obtaining Coating Composition 6.

Coating Composition 7:

100 parts of the resin varnish obtained in Preparation Example 7, 23 parts of diethylene glycol diacrylate, 40 parts of talc, 20 parts of clay, and 5.0 parts of titanium oxide were weighed and they were uniformly mixed together by a high-spped kneader to obtain a basic composition. Coronate HL was added to the above so as to adjust the molar ratio NCO/HO to 1.0, thereby obtaining Coating Composition 7.

Coating Composition 8:

After mixing well 100 parts of the resin varnish obtained in Preparation Example 1 and 80 parts of hexanediol diacrylate, 2 parts of benzoin methyl ether and 200 parts of aggregate (Hakuoseki 5-rin; trademark of marble granules, 2 mmϕ, made by Sankyo Seifun Co., Ltd.), were added to obtain a basic composition. Desmodur N (trademark of a product of Farbenfabriken Bayer A. G.) was added to the above basic composition so as to adjust the molar ratio NCO/OH to 1.0, thereby obtaining Coating Composition 8.

Test Examples

The Coating Compositions prepared as above were applied on several substrates in Examples 1 to 7 as shown in the following Table 1 and they were cured under the conditions as shown in Table 2. With regard to these coated test pieces, scratch test, crack resistance test and adhesion test were performed. The results of these tests are shown in the following Table 3.

The brief procedures for these tests were as follows:

Scratch Test with Coins:

A coated surfaces was strongly rubbed with a 10 yen coin (made of copper) by three times and the state of the rubbed surface was observed with the naked eye.

Results of this test were indicated by: ◎ (no change), ○ (a slight scratch) and Δ (scratched).

Crack Resistance Test:

A coated test piece was kept at 70° C. for 1 hour, it was then immersed in water for 2 hours and further it was kept at −20° C. for 1 hour. After this procedure was repeated twice, the test piece was applied with ultraviolet rays for 16 hours. The above test cycle was repeated by 20 times and the state of coated surface was observed with the naked eye.

Results of this test were indicated by: ◎ (no change), ○ (a little crack) and Δ (cracks).

Adhesion Test:

Adhesive (trademark: Araldite, made by Ciba Ltd.) was applied to a 40×40 mm area of a test piece and a piece of glue tape was applied to the urea. After the adhesive was cured, the tape was peeled off and the adhesive property of the coating film was observed.

Results of this test were indicated by: ◎ (no change) ○ (a little peeled) and Δ (peeled more than 50%).

Table 1

| Example | Substrate | Coating Composition | Coating Procedure |
|---|---|---|---|
| 1 | Bonderized steel sheet (made by Nippon steel Corp.) | Coating Comp. 1 | Substrate → application of primer of Preparation Ex. 9 (baked at 250° C. for 30 sec., film thickness: 5μ) → application of Coating Comp. 1 (sand-texture finish, 300μ) → irradiation of electron beams |
| 2 | Slate plate (Thickness: 6 mm) | Coating Comp. 2 | Substrate → application of Coating Comp. 2 (300μ) → spreading of siliceous sand → application of Coating Comp. 2 → irradiation of electron beams |
| 3 | Linder Plywood (Thickness: 9 mm) | Coating Comp. 3 | Substrate → application of Coating Comp. 3 (350μ) → spreading of glass fiber (trademark: RS240F-128, made by Nitto Boseki Co., Ltd.) → application of Coating Comp. 3 (100μ) → irradiation of electron beams |
| 4 | Galvanized steel sheet | Coating Comp. 4-material made by removing aggregate from Coating | Substrate → application of primer of Preparation Ex. 9 (baked at 250° C. for 30 sec., film thickness: 5μ) → application of Coating Comp. 4 (sand-texture) finish, 500μ) → application of Coating Comp. 1 (without aggregate, 50μ) |

Table 1-continued

| Example | Substrate | Coating Composition | Coating Procedure |
|---|---|---|---|
| | | Comp. 1 | → irradiation of electron beams |
| 5 | Particle board | Coating Comp. 5-Coating Comp. 3 | Substrate → application of Coating Comp. 5 (500μ) → application of Coating Comp. 3 (50μ) → irradiation of electron beams |
| 6 | Galvanized steel sheet | Coating Comp. 7-Coating Comp. 6 | Substrate → application of Zinc Rich Paint ZE 500 (trademark, made by Kansai Paint Co., Ltd., thickness: 75μ) → air-drying for 1 day → application of Coating Comp. 7 (rough pattern finish 3–4 mm) → application of Coating Comp. 6 (50μ) → irradiation of electron beams |
| 7 | Aluminium (52S) plate | Coating Comp. 8 | Substrate → application of Coating Comp. 8 (sand-texture finish 80μ) → irradiation of ultraviolet rays |
| Comp. Example 1 | Bonderized steel sheet (made by Nippon Steel Corp.) | Material made by removing Coronate HL from Coating Comp. 1 (Comparative Coating Comp.) | Substrate → application of primer of Preparation Ex. 9 (brked at 250° C. for 30 sec., film thickness: 5μ) → application of Comparative Coating Comp. (sand-texture finish, 300μ) → irradiation of electron beams |

Table 2

| Ex. | Coating Method | Curing Condition |
|---|---|---|
| 1 | Spraying | Transformer type electron beam accelerator, electron energy: 300 KeV, irradiated 15 Mrad with electron beam current of 45 mA |
| 2 | Roller coaster - curtain flow coater | Transformer type electron beam accelerator, electron energy: 300 KeV, irradiated 15 Mrad with electron beam current of 45 mA |
| 3 | Sponger roller - spraying | Transformer type electron beam accelerator, electron energy: 300 KeV, irradiated 15 Mrad with electron beam current of 45 mA |
| 4 | Spraying | Transformer type electron beam accelerator, electron energy: 300 KeV, irradiated 15 Mrad with electron beam current of 45 mA |
| 5 | Spraying-spraying | Transformer type electron beam accelerator, electron energy: 300 KeV, irradiated 15 Mrad with electron beam current of 45 mA |
| 6 | Spraying (mortar gun) - spraying | Transformer type electron beam accelerator, electron energy: 300 KeV, irradiated 15 Mrad with electron beam current of 45 mA |
| 7 | Spraying | Irradiated for 1 min. with a 4 KW high pressure mercury lamp under nitrogen gas current |
| Comp. Ex. 1 | Spraying | The same as Example 1 |

Table 3

| Example | Coating Properties | | |
|---|---|---|---|
| | Stratch Test with Coin | Crack Resistance Test | Adhesion Test |
| 1 | ◎ | ◎ | ◎ |
| 2 | ◎ | ◎ | ◎ |
| 3 | ◎ | ◎ | ◎ |
| 4 | ◎ | ◎ | ◎ |
| 5 | ◎ | ◎ | ◎ |
| 6 | ◎ | ◎ | ◎ |
| 7 | ○ | ○ | ○ |
| Comp. Example 1 | Δ | ○ | Δ |

In the following, another kind of coating composition which comprises polymerizable resin (I), polyisocyanate compound (II) and the resin (III) having active unsaturated groups will be explained with reference to several examples.

Preparation Example 10

| Used Starting monomers were as follows: | |
|---|---|
| (a) n-butyl acrylate | 352 parts |
| (b) styrene | 186 parts |

Preparation Example 10-continued

| Used Starting monomers were as follows: | |
|---|---|
| (c) glycidyl methacrylate | 77 parts |
| (d) hydroxy acrylate | 2 parts |

In nitrogen blanket, xylene in a reaction vessel was heated to 130° C. with continuous stirring. The above monomers (a), (b), (c) and (d) and 0.2 part of benzoyl peroxide as a reaction inhibitor were added to the xylene little by little over 3 hours. The total mixture was heated for about 3 hours at 130°–135° C., and then cooled to about 50° C. To the contents were added 39 parts of acrylic acid and 0.5 part of hydroquinone and the temperature of the mixture was gradually raised to 138° C. over about 1.5 hours. It was kept at this temperature for about 1 hour to obtain 70% acrylic polymer.

Preparation Example 11

| Used starting monomers were as follows: | |
|---|---|
| (a) n-butyl acrylate | 347 parts |
| (b) styrene | 184 parts |
| (c) glycidyl methacrylate | 77 parts |
| (d) hydroxy acrylate | 10 parts |

In like manner as the above Preparation Example 10 except that the above monomers (a), (b), (c) and (d) were used, 70% acrylic polymer was prepared.

Preparation Example 12

A 5 lit, flask was fed with 820 g of orthophosphorous acid and 3000 g of polypropylene glycol diglycidyl ether (number average molecular weight: 600) and they were allowed to react at 100° C. for 5 hours. When the acid value became 150, the reaction was stopped. To this reaction product were added 0.5 g of hydroquinone and 1280 g of glycidyl acrylate, and the mixture was further allowed to react for 5 hours at 100° C. The reaction was stopped when the acid value became less than 10.

Preparation Example 13

Materials of 1000 g of copolymer (glycidyl methacrylate: methyl methacrylate: ethyl acrylate, number average molecular weight: 15000, epoxy groups: 1 mole/kg), equimolar adduct of sulfuric acid and hydroxyethyl acrylate, 1098 g of benzene and 1 g of hydroquinone, were allowed to react at the boiling point of benzene. After 3 hours when the acid value became 3, the reaction was stopped.

EXAMPLE 8

To 70 parts of the 70% acrylic polymer prepared in Preparation Example 10 were added 8 parts of 2-ethylhexyl acrylate, 10 parts of 1,6-hexanediol dimethacrylate and 12 parts of toluene to obtain 49% resin solution. A coating composition was prepared by adding 4 parts of the unsaturated resin (solid content: 60%) obtained in Preparation Example 12 and 5 parts of 75% Desmodur N (trademark of an isocyanate compound made by Farbenfabriken Bayer A. G.) to 100 parts of the above resin solution. The coating composition was applied to the surfaces of test pieces made of cold finished mild steel sheet and the test pieces were irradiated with 7 Mrad of ionized radiation to cure the coating films, in which the pot life of the coating composition and adhesive property, solvent resistance and pencil hardness of the cured coating films were measured.

Examples 9–12 and Comparative Examples 2–4

Several coating compositions were prepared in accordance with the formulae indicated in the following Table 4 and in like manner as Example 8. Coating films were formed also in like manner as Example 8 and they were cured in accordance with the conditions shown in the following Table 5. The pot lives of the coating composition and the properties of the cured coating films were tested, the results of which are shown in the following Table 6.

The test methods were as follows:

Pot Life:

The time (hours) in which gelation occurred after mixing with isocyanate compound.

Pencil Hardness:

Pencil scratch tests were carried out with regard to the cured coating films just after the curing and after 1 day's standing still in a room.

Solvent Resistance:

A few drops of xylene were put on a coating surface and the xylene was wiped off with gauze, after that, the surface of coating was observed with the naked eye.

Adhesiveness:

100 squares (each 1×1 mm) in a checked pattern were formed in the coating film with two sets of eleven knife-cut lines that reached the substrate surface. The test piece was depressed by 1 mm from the back side thereof with an Erichsen tester. A sheet of self-adhesive tape was applied to the surface of such coating film and the tape was then peeled off abruptly. The remaining squares of coating films were counted.

Table 4

| | Example | | | | Comparative Example | | |
|---|---|---|---|---|---|---|---|
| Material (parts) | 9 | 10 | 11 | 12 | 2 | 3 | 4 |
| Resin of Preparation Ex. 10 | | | | | | 70 | 70 |
| Resin of Preparation Ex. 11 | 70 | 70 | 70 | 70 | 70 | | |
| Resin of Preparation Ex. 12 | 4 | | 8 | 4 | | | |
| Resin of Preparation Ex. 13 | | 3 | | | | | |
| 2-ethylhexyl acrylate | 8 | | 6 | 8 | 8 | 8 | 8 |
| 1,6-hexanediol diacrylate | 10 | | 10 | 10 | 10 | 10 | 10 |
| Methyl methacrylate | | 18 | | | | | |
| 75% Desmodur N | 17 | 17 | 17 | 17 | 17 | — | — |
| Toluene | 12 | 12 | 12 | 12 | 12 | 12 | 12 |
| Additive | — | Benzoyl ethyl ether | — | — | — | — | — |
| Total | 121 | 120 | 123 | 121 | 117 | 100 | 100 |

Table 5

| | Example | | | | Comparative Example | | |
|---|---|---|---|---|---|---|---|
| Item | 9 | 10 | 11 | 12 | 2 | 3 | 4 |
| Curing Method | Ionizing radiation | Ultraviolet rays (high pressure mercury lamp) | Ionizing radiation | Room temperature | Ionizing radiation | Ionizing radiation | Room temperature |
| Curing Condition | 7 Mrad | 30 cm apart 1 minute | 7 Mrad | 20° C. | 7 Mrad | 7 Mrad | 20° C. |

Table 6

| | Example | | | | | Comparative Example | | |
|---|---|---|---|---|---|---|---|---|
| Test Item | 8 | 9 | 10 | 11 | 12 | 2 | 3 | 4 |
| Pol Life (Hrs) (20° C.) | 48 | 30 | 24 | 48 | 30 | 1.5 | — | — |
| Pencil Hardness | | | | | | | | |
| Just after Irradiation | B | HB | 2B | B | — | HB | HB | — |
| After Indoor Leaving for 1 Day | H | 2H | HB | 2H | HB | 2H | HB | Not cured |
| Solvent Resistance (Xylene) | | | | | | | | |
| Just after Irradiation | No change | No change | No change | No change | — | No change | No change | — |
| After Indoor Leaving for | No change | No | No change | No change | No change | No change | No change | — |

Table 6-continued

| Test Item | Example 8 | 9 | 10 | 11 | 12 | Comparative Example 2 | 3 | 4 |
|---|---|---|---|---|---|---|---|---|
| 1 day Adhesiveness | 100/100 | 100/100 | 100/100 | 100/100 | 100/100 | 80/100 | 30/100 | Test impossible |

What is claimed is:

1. A method for forming cured high build coating film which method comprises the steps of: preparing a coating composition by mixing a polymerizable resin (I) as the main vehicle component which is curable by the irradiation of electron beams or ultraviolet rays and has at least two polymerizable unsaturated double bonds and at least one hydroxyl group in its molecule, and a polyisocyanate compound (II); applying said coating composition to the surface of a substrate to be coated; and irradiating electron beams or ultraviolet rays to the coated surface.

2. A method for forming cured high build coating film as claimed in claim 1, wherein a resin (III) having active unsaturated groups is added to said coating composition, said resin (III) being the reaction product of a compound having epoxy groups with a monomer having both epoxy group and active unsaturated group and at least one member selected from the group consisting of orthophosphoric acid, orthophosphorous acid and sulfuric acid.

3. A high build coating composition which comprises a polymerizable resin (I) as the main vehicle component which is curable by the irradiation of electron beams or ultraviolet rays and has at least two polymerizable unsaturated double bonds and at least one hydroxyl group in its molecule, and a polyisocyanate compound (II).

4. A high build coating composition as claimed in claim 3, wherein a resin (III) having active unsaturated groups is added to said coating composition, and said resin (III) being the reaction product of a compound having epoxy groups with a monomer having both epoxy group and active unsaturated group and at least one member selected from the group consisting of orthophosphoric acid, orthophosphorous acid and sulfuric acid.

5. A high build coating composition as claimed in claim 3 wherein said resin (I) is cured by the irradiation of electron beams.

6. A method for forming cured high build coating film as claimed in claim 1 wherein said resin (I) is cured by the irradiation of electron beams.

7. A high build coating composition as claimed in claim 5, wherein said polymerizable resin (I) is at least one member selected from the group consisting of acrylic resin, polyester resin, epoxy resin, polyurethane resin and butadiene resin.

8. A method for forming cured high build coating film as claimed in claim 6 wherein the ratio of hydroxyl groups of said resin I to the NCO groups of polyisocyanate compound II is 0.8–1.6.

9. A method for forming cured high build coating film as claimed in claim 2 wherein said resin III is employed in an amount of 1–40 parts per 100 parts of said resin I and said acid is 1–50% of said resin III.

10. A method for forming cured high build coating film as claimed in claim 9 wherein said acid is 2–30% of said resin III.

11. A high build coating composition as claimed in claim 5 wherein the ratio of OH groups in said resin I to the NCO groups in said polyisocyanate compound II is 0.8–1.6.

12. A high build coating composition as claimed in claim 4 wherein said resin III is present in an amount of 1–40 parts per 100 of said resin I and contains 1–50% of said acid.

13. A high build coating composition as claimed in claim 12 wherein the amount of said acid is 2–30% and the ratio of OH groups in said resin I to NCO groups in said polyisocyanate compound II is 0.8–1.6.

14. A high build coating composition as claimed in claim 3 wherein said resin I is an acrylic resin reaction product of n-butyl acrylate, styrene, glycidyl methacrylate, 2-hydroxyethyl acrylate, and acrylic acid.

* * * * *